United States Patent [19]

Douglas

[11] 4,432,521

[45] Feb. 21, 1984

[54] CRADLE CASE

[76] Inventor: Jack Douglas, 11645 Montana Ave., Los Angeles, Calif. 90049

[21] Appl. No.: 275,998

[22] Filed: Jun. 22, 1981

[51] Int. Cl.[3] ..... F16M 11/00

[52] U.S. Cl. ..... 248/176; 211/13; 297/218

[58] Field of Search ..... 248/309 R, 176; 211/13; D6/184, 190; 297/440, 218

[56] References Cited

U.S. PATENT DOCUMENTS

| | | | |
|---|---|---|---|
| D. 170,098 | 7/1953 | Swanson | D6/184 |
| D. 222,151 | 10/1971 | Majewski | D6/190 |
| D. 244,410 | 5/1977 | Pietsch | D6/85 |
| D. 245,056 | 7/1977 | Winther | D6/185 |
| D. 246,565 | 12/1977 | Roark | D6/85 |
| D. 251,886 | 5/1979 | Lohse | D6/184 |
| D. 252,064 | 6/1979 | Woodhall | D6/185 |
| 1,550,138 | 8/1925 | Baker | 248/176 X |
| 1,686,002 | 10/1928 | Herzon | 248/DIG. 2 |
| 2,664,148 | 12/1953 | Rechler | 297/440 X |
| 2,692,637 | 10/1954 | Rainwater | 297/440 |
| 2,794,757 | 6/1957 | Bright | 297/218 |
| 2,836,833 | 6/1958 | Carlson | 297/218 |
| 3,281,185 | 10/1966 | Albinson et al. | 297/218 |
| 3,423,775 | 1/1969 | Cockerill | 297/218 |
| 3,490,809 | 1/1970 | Lange | 297/440 |
| 3,519,138 | 7/1970 | Murray | 211/13 |
| 4,270,660 | 6/1981 | Putt | 211/13 |

*Primary Examiner*—Ramon S. Britts
*Assistant Examiner*—Sarah A. Lechok
*Attorney, Agent, or Firm*—John J. Posta, Jr.

[57] ABSTRACT

An improved eyeglass holder is provided which includes an elongated base having a flat bottom and upstanding opposed spaced sides defining a central space therebetween. The upper ends of the sides terminate in lips which diverge outwardly from each other. A flexible eyeglass cradle preferably of several interconnected layers of soft flexible resilient material overlays and is secured to at least a portion of the lips and depends therefrom in the central space above the base bottom. The cradle covers the lips to prevent damage to eyeglasses when they are passed into the cradle. In one embodiment one or more cradle layers have tabs extending outwardly from the side margins thereof through opening(s) in the lips and are secured against the inner or outer surface thereof by rods disposed in the tubes. The lips themselves may also have extensions defining spaced openings alignable with the tab tubes or may have spaced pins over which the tab tubes are releasably secured. Alternatively, the cradle side margins can be straight and can be clamped to the lip ends. The holder is simple, inexpensive, durable and efficient. It can be fabricated in a variety of configurations of suitable design to assure safe convenient storage of eyeglasses.

5 Claims, 12 Drawing Figures

CRADLE CASE

BACKGROUND OF THE INVENTION

1. Field of the Invention

The present invention generally relates to holders and more particularly to novel eyeglass holders which protect various types of eyeglasses.

2. Prior Art

Eyeglasses are frequently taken off and put back on by the user during reading, work on equipment, etc. In most cases, the eyeglasses are merely casually placed on a desk, work bench or table in or around the work, the T.V. set, magazines, dinner table, etc. When they are to be put on again, the user usually must look for them in order to find them. Frequently, eyeglasses thus so casually treated are dropped on the floor, and may be damaged, misplaced, etc. Although portable eyeglass cases are suitable for storing eyeglasses for periods of time when not in use and for transporting eyeglasses, they are generally totally unsuitable when it is desired to put down such eyeglasses frequently and only temporarily and then pick them up again.

Accordingly, there is a need for an inexpensive, attractive and durable eyeglass holder which can be conveniently placed on a desk, table, etc. and which will provide a safe accessible place into which eyeglasses can be easily placed and them removed as needed.

SUMMARY OF THE INVENTION

The eyeglass holder of the present invention satisfied all the foregoing needs. The holder is substantially as set forth in the Abstract above. Thus, it comprises an open topped base having spaced upstanding sides bearing outwardly directed lips at their upper ends, and a flexible resilient cushion cradle supported by and overlapping the lips and depending between the sides. The cradle may be clipped at its side margins to the lips or can include side tabs formed into tubes which are releasably secured to integral lip pins or the rods which hold the tube against the lips. The lips may define rod-receiving passageways, if desired.

Preferably, the cradle is of a plurality of layers of soft flexible material such as cloth, rubber, batting, leather, etc. stitched together. The base preferably has a flat bottom and is formed of plastic with rounded edges. The lips are overlaid by the cradle to protect the eyeglasses from injury and the cradle is suspended above the flat bottom for the same reason. Further detailed information is set forth in the following description and accompanying drawings.

DETAILED DESCRIPTION OF THE PREFERRED EMBODIMENT

FIGS. 1–7

Figure 1:
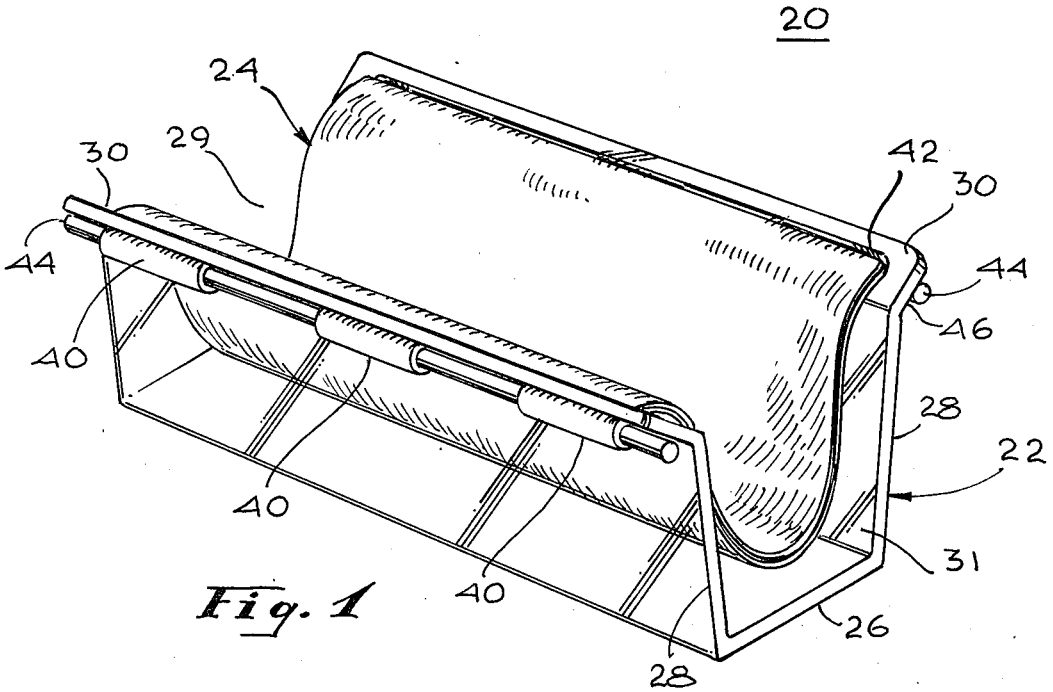
FIG. 1 is a schematic perspective view of a first preferred embodiment of the improved eyeglass holder of the present invention.
Figure 2:
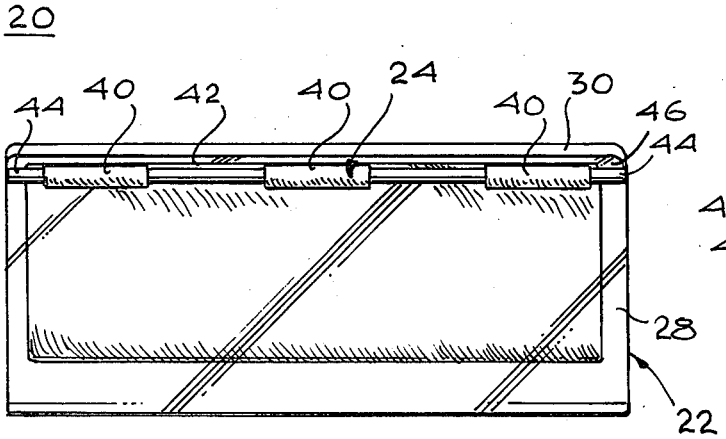
FIG. 2 is a schematic side elevation of the eyeglass holder of FIG. 1.
Figure 3:
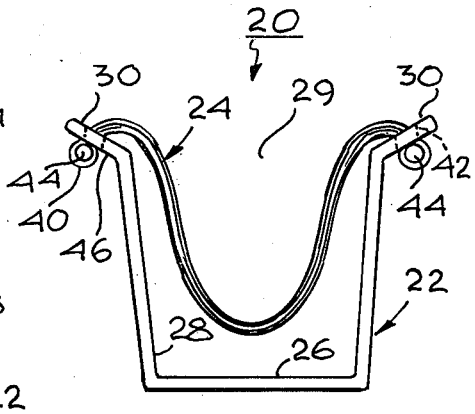
FIG. 3 is a schematic end view of the eyeglass holder of FIG. 1.
Figure 4:
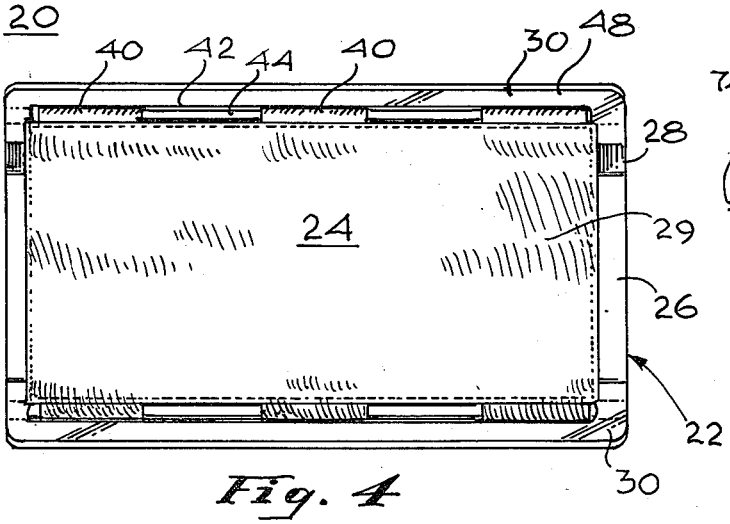
FIG. 4 is a schematic top plan view of the eyeglass holder of FIG. 1.

A first preferred embodiment of the improved eyeglass holder of the present invention is schematically depicted in FIGS. 1–7. Thus, holder 20 is shown which comprises a base 22 and a cradle 24. Base 22 comprises an open topped, open ended elongated trough having a flat closed bottom 26 and upstanding, spaced, opposed, slightly diverging sides 28, the upper ends of which terminate in upwardly and outwardly angled diverging lips 30. A central space 31 is defined between sides 28.

Preferably, base 22 is fabricated of clear polystyrene or the like plastic or another attractive inexpensive durable material, such as wood, metal, etc. and may be of any suitable size, for example 6 inches in length and 4 inches in heighth and width. Base 22 employs smoothly rounded corners and lips 30 thereof which aid in directing the user to cradle 24 disposed in space 29 above bottom 26.

Figure 6:
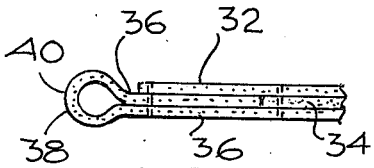
FIG. 6 is an enlarged fragmentary schematic end view of the details of construction of one of the tap tubes of the cradle of FIG. 1.

Cradle 24 comprises a single or multiple layers of soft flexible, resilient material, such as cloth, leather, rubber or the like suspended by lips 30 and depending freely in space 29. In the embodiment shown in FIGS. 1–7, cradle 24 inclues three layers stitched together, a rectangular top layer 32 of cloth or the like, a smaller middle cushion layer 34 of cotton batting foam rubber or the like and a bottom layer 36 of cloth, leather, etc.with spaced tabs 38 extending outwardly from the side margins thereof. Tabs 38 are formed into tubes 40, as shown in FIG. 6 and are stitched in place.

In the arrangement of FIGS. 1–4, tabs 38 extend outwardly of base 22 through slits 42 in the upper portions of lips 30 so that the inner surfaces of lips 30 are overlaid by cradle 24, thus protecting eyeglasses from direct contact with lips 30. Aligned tubes 40 have elongated rods 44 disposed therethrough to hold tubes 40 against the outer surfaces 46 of lips 30 (FIGS. 1–4).

Figure 7:
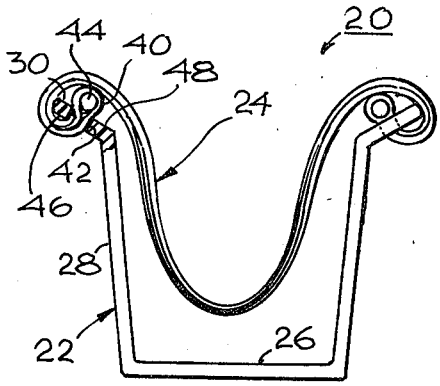
FIG. 7 is a schematic end view of a modified manner of attachment of the cradle of FIG. 1 to the base of FIG. 1.

In the alternative arrangement shown in FIG. 7, cradle 24 is reflected up over the upper ends of lips 30 and tubes 40 pass inwardly through slits 42 and are held against the inner surfaces 48 of lips 30. In this version, surfaces 48 are fully covered by cradle 24 to fully protect eyeglasses from contact therewith.

Rods 44 can be of wood, glass, plastic, metal, etc. and can be easily inserted into tubes 40 and as easily removed to allow holder 20 to be disassembled. Cradle 24 securely holds eyeglasses in full view for easy access while protecting them against damage. Thus, holder 20 is of novel construction and improved utility. It can be fabricated simply and inexpensively, is of attractive appearance and is durable. It can be easily placed on a desk top, table, counter, for safe and handy use as needed.

Figure 9:
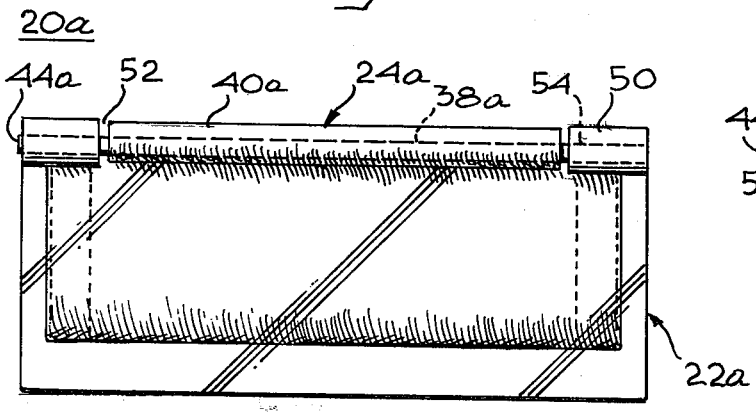
FIG. 9 is a schematic side elevation of the eyeglass holder of FIG. 8.
Figure 8:
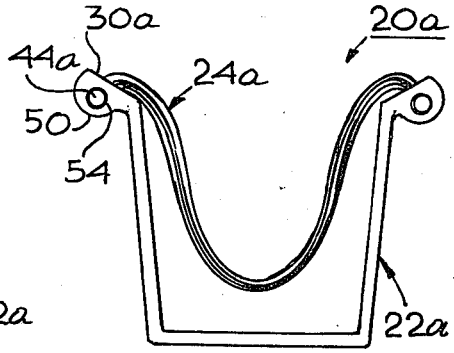
FIG. 8 is a schematic end view of a second preferred embodiment of the improved eyeglass holder of the present invention.

FIGS. 8 and 9

A second preferred embodiment of the improved eyeglass holder of the present invention is schematically depicted in FIGS. 8 and 9. Thus, holder 20*a* is shown which is generally similar to holder 20. Components thereof similar to those of holder 20 bear the same numerals but are succeeded by the letter "a". Thus, holder 20*a* comprises base 22*a* substantially identical to base 22, except that lips 30*a* include thickened outward extensions 50 and are disposed only at the ends of base 22, spaces 52 being provided therebetween.

Extensions 50 define aligned openings 54 extending longitudinally therethrough. Moreover, cradle 24*a* includes a single tab 38*a* and tube 40*a* formed therefrom at each side margin thereof and disposed in each space 52. Rods 44*a* extend through openings 54 and tubes 40*a* to releasably lock cradle 24*a* in place in base 22*a*, as shown in FIGS. 8 and 9. Thus, holder 20*a* has the advantages of holder 20 and can be constructed of similar materials.

Figure 10:
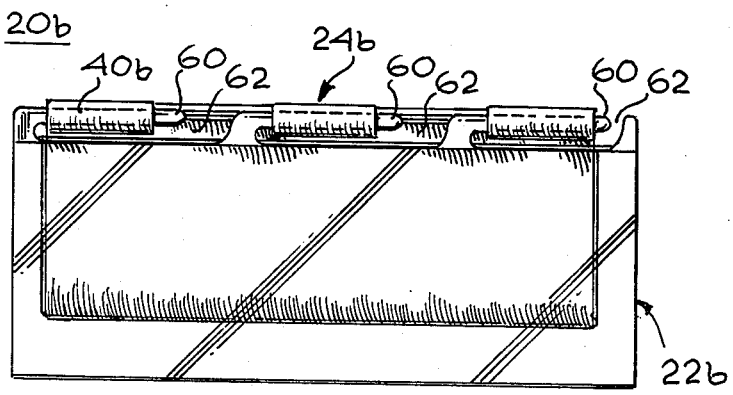
FIG. 10 is a schematic side elevation of a third preferred embodiment of the improved eyeglass holder of the present invention.
Figure 11:
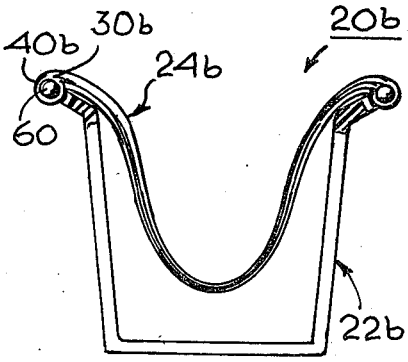
FIG. 11 is a schematic end view of the eyeglass holder of FIG. 10.

FIGS. 10 and 11

A third preferred embodiment of the improved eyeglass holder of the present invention is schematically depicted in FIGS. 10 and 11. Thus, holder 20*b* is shown which is generally similar to holder 20. Components thereof similar to those of holder 20 bear the same numerals but are succeeded by the letter "b". Holder 20*b* includes base 22*b* and cradle 24*b*. Base 22*b* differs from base 22 in that slits 42 are absent and lips 30*b* are configured to define aligned, spaced, longitudinally extending integral pins 60 and cutaway portions 62 therearound (FIG. 10). Tubes 40*b* can be easily slipped over pins 60 to hold cradle 24*b* in place on base 22*b*. Holder 20*b* has substantially the same advantages as holder 20 and can be constructed of similar materials.

FIG. 12

Figure 12:
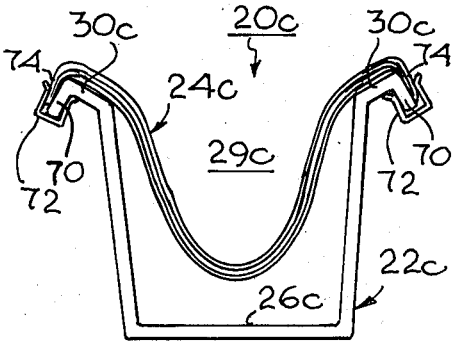
FIG. 12 is a schematic end view of a fourth preferred embodiment of the improved eyeglass holder of the present invention.
Figure 5:
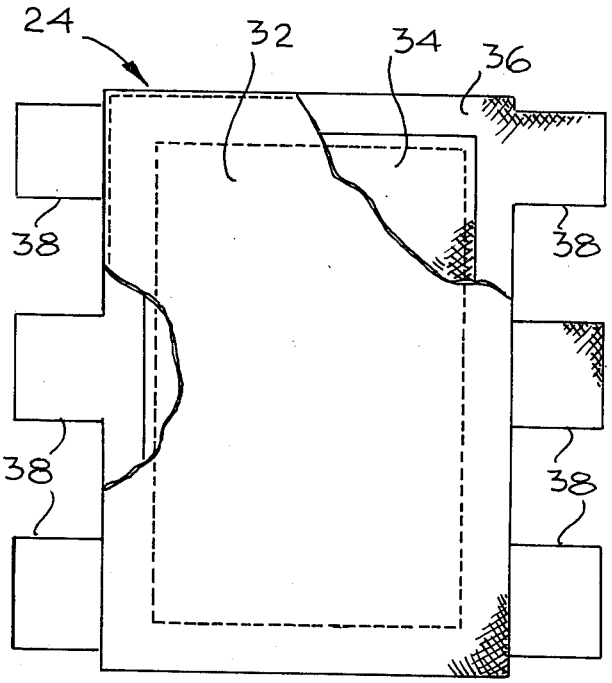
FIG. 5 is a schematic top plan view, partly broken away of the cradle portion of the eyeglass holder of FIG. 1 in the flattened position before forming the tabs thereof into tubes.

A fourth preferred embodiment of the improved eyeglass holder of the present invention is schematically depicted in FIG. 12. Thus, holder 20*c* is shown which is generally similar to holder 20. Components thereof similar to those of holder 20 bear the same numerals but are succeeded by the letter "c". Holder 20*c* includes base 22*c* and cradle 24*c*. Base 22*c* has lips 30*c* which terminate in outwardly and downwardly directed ends 70. No slits 42 are present in lips 30*c* nor are tabs 38 and tubes 40 present in cradle 24*c*.

Instead, cradle 24*c* is reflected over lips 30*c* and down the outside thereof, and elongated generaly U-shaped spring or tension clips 72 of plastic, metal etc. releasably hold the straight side margins 74 of cradle 24*c* against ends 70 so that the main body of cradle 24*c* freely depends in space 29*c* above bottom 26*c*. Thus, holder 20*c* has the advantage of holders 20, 20*a* and 20*b* and can be constructed of similar materials.

Due to the specific construction employed, it can be readily appreciated that if the top side of the cradle 24 becomes worn, it can be reversed; i.e., the top side becomes the bottom side and vice versa. Also, if leather is the material used for cradle 24, cradle 24 would preferably be constructed so that the soft side of the leather is presented on both outside surfaces of cradle 24.

Various modifications, changes, alterations and additions can be made in the novel eyeglass holder of the present invention and in the components and parameters thereof. All such changes, modifications, alterations and additions as are within the scope of the appended claims form part of the present invention.

What is claimed is:

1. An improved eyeglass holder, said holder comprising, in combination:

(a) a base having a bottom support and upstanding opposed sides, defining a central space therebetween, the upper ends of said sides terminating in lips which diverge outwardly from each other, (b) a flexible eyeglass cushion cradle overlapping at least a portion of said lips and depending from said lips in said space, (c) wherein said lips are angled mainly upwardly and outwardly from said base and wherein at least a portion of the side margins of said cradle are secured to said lips, (d) wherein said cradle comprises a plurality of layers of soft flexible material secured together, and (e) wherein at least one of said layers includes tabs which extend outwardly of the side margins of said cradle and are disposed through said lips and formed into tubes and wherein elongated rods are disposed through said tubes to lock said cradle to said lips.

2. The improved holder of claim 1 wherein said tubes and rods are disposed against the outer surfaces of said lips.

3. The improved holder of claim 1 wherein said tubes and rods are disposed against the inner surfaces of said lips and the portions of said cradle adjacent said tubes are reflected over said tubes and rods.

4. The improved holder of claim 1 wherein said lips include longitudinally spaced outwardly depending extensions defining aligned openings adapted to receive said rods and wherein said tubes are disposed between and in alignment with said extensions.

5. An improved eyeglass holder, said holder comprising, in combination:

(a) a base having a bottom support and upstanding opposed sides, defining a central space therebetween, the upper ends of said sides termianting in lips which diverge outwardly from each other, (b) a flexible eyeglass cushion cradle overlapping at least a portion of said lips and depending from said lips in said space, (c) wherein said lips are angled mainly upwardly and outwardly from said base and wherein at least a portion of the side margins of said cradle are secured to said lips, (d) wherein said cradle comprises a plurality of layers of soft flexible material secured together, and (e) wherein said lips define spaced longitudinally extending pins and wherein at least one of said layers includes tabs which extend outwardly of the side margins of said cradle and are formed into tubes releasably disposed on said pins.

* * * * *